US012679634B2

(12) United States Patent
Pherson

(10) Patent No.: US 12,679,634 B2
(45) Date of Patent: Jul. 14, 2026

(54) REMOVABLE CARGO CONTAINER BASE BRACKETS

(71) Applicant: Advanced Composite Structures, LLC, Charleston, SC (US)

(72) Inventor: Thomas R. Pherson, Daniel Island, SC (US)

(73) Assignee: Advanced Composite Structures, LLC, Charleston, SC (US)

( * ) Notice: Subject to any disclaimer, the term of this patent is extended or adjusted under 35 U.S.C. 154(b) by 0 days.

(21) Appl. No.: 19/029,208

(22) Filed: Jan. 17, 2025

(65) Prior Publication Data

US 2025/0178829 A1 Jun. 5, 2025

Related U.S. Application Data

(63) Continuation of application No. 17/971,075, filed on Oct. 21, 2022, now Pat. No. 12,246,914.

(60) Provisional application No. 63/270,754, filed on Oct. 22, 2021.

(51) Int. Cl.
*B65D 90/12* (2006.01)
*B65D 90/08* (2006.01)

(52) U.S. Cl.
CPC ..... *B65D 90/12* (2013.01); *B65D 90/08* (2013.01)

(58) Field of Classification Search
CPC ..... B65D 90/12; B65D 90/08; B65D 88/14; B65D 19/0059; B65D 2519/00567; B65D 2519/0099; B65D 2519/00986; B65D 2519/00985; B65D 19/06; B65D 2519/00273
USPC ..... 206/386
See application file for complete search history.

(56) References Cited

U.S. PATENT DOCUMENTS

| | | | |
|---|---|---|---|
| 3,396,678 | A | 8/1968 | Jensen |
| 3,428,002 | A | 2/1969 | McIntire, Jr. et al. |
| 3,429,536 | A | 2/1969 | Petry et al. |
| 3,509,832 | A | 5/1970 | Daisley, Jr. |
| 3,511,737 | A | 5/1970 | Oita et al. |
| 3,591,121 | A | 7/1971 | Parris |
| 3,622,114 | A | 11/1971 | McIntire, Jr. |
| 3,626,860 | A | 12/1971 | Blatt |
| 3,719,157 | A | 3/1973 | Arcocha et al. |

(Continued)

FOREIGN PATENT DOCUMENTS

| | | |
|---|---|---|
| DE | 20003292 U1 | 5/2000 |
| DE | 10060805 A1 | 8/2001 |

(Continued)

OTHER PUBLICATIONS

International Search Report and Written Opinion for PCT/IB2022/060157 dated Jan. 25, 2023, 152 pages.

(Continued)

*Primary Examiner* — Stephen J Castellano
(74) *Attorney, Agent, or Firm* — Womble Bond Dickinson (US) LLP

(57) ABSTRACT

A base for a cargo container including a bottom plate, a top plate, risers, and a bracket. The top plate has a top surface that faces away from the bottom plate. The risers interconnect the top plate and the bottom plate. The bracket extends between the top plate and the bottom plate and is configured to maintain a distance between the top plate and the bottom plate. The bracket is replaceable from the base without access to the top surface of the top plate.

20 Claims, 11 Drawing Sheets

(56) References Cited

U.S. PATENT DOCUMENTS

| | | | | |
|---|---|---|---|---|
| 4,230,049 | A | 10/1980 | Horne | |
| 4,347,794 | A | 9/1982 | Nordstrom | |
| 4,404,889 | A | 9/1983 | Miguel | |
| 4,558,553 | A | 12/1985 | Kolk | |
| 4,874,648 | A | 10/1989 | Hill | |
| 5,195,439 | A | 3/1993 | Harder | |
| 5,205,221 | A | 4/1993 | Melin et al. | |
| 5,284,098 | A | 2/1994 | Klapperich et al. | |
| 5,360,129 | A | 11/1994 | Lee | |
| 5,442,878 | A | 8/1995 | Flores | |
| 5,567,500 | A | 10/1996 | Marshall et al. | |
| 5,687,652 | A | 11/1997 | Ruma | |
| 5,981,025 | A | 11/1999 | Marshall et al. | |
| 6,109,190 | A * | 8/2000 | Hale | B65D 19/0016 108/57.25 |
| 6,117,518 | A | 9/2000 | Cawse et al. | |
| 6,214,436 | B1 | 4/2001 | Catta et al. | |
| 6,308,642 | B1 | 10/2001 | Branam et al. | |
| 6,655,299 | B2 | 12/2003 | Preisler et al. | |
| 6,705,237 | B2 | 3/2004 | Moore et al. | |
| 6,758,148 | B2 | 7/2004 | Torrey et al. | |
| 7,013,814 | B2 | 3/2006 | Modesitt et al. | |
| 7,156,249 | B2 | 1/2007 | Heinrichs | |
| 7,785,693 | B2 | 8/2010 | Johnson | |
| 7,846,528 | B2 | 12/2010 | Johnson | |
| 7,854,204 | B2 | 12/2010 | Dacus | |
| D630,815 | S | 1/2011 | Teien | |
| 8,002,919 | B2 | 8/2011 | Johnson | |
| 8,567,324 | B1 | 10/2013 | Paradis et al. | |
| 8,776,698 | B2 | 7/2014 | Pherson | |
| 2003/0061974 | A1 | 4/2003 | Smyers | |
| 2006/0096508 | A1 | 5/2006 | Herring | |
| 2007/0194019 | A1 | 8/2007 | Seagle et al. | |
| 2008/0145592 | A1 | 6/2008 | Johnson | |
| 2008/0237305 | A1 | 10/2008 | Rennick et al. | |
| 2009/0116925 | A1 | 5/2009 | Juchniewicz et al. | |
| 2009/0277579 | A1 | 11/2009 | Marelli et al. | |
| 2011/0120353 | A1 | 5/2011 | Jensen et al. | |
| 2011/0247958 | A1 | 10/2011 | Lucas et al. | |
| 2012/0024740 | A1 | 2/2012 | Gollnick et al. | |
| 2016/0068302 | A1 | 3/2016 | Clark et al. | |
| 2017/0225826 | A1* | 8/2017 | Xie | B65D 19/38 |

FOREIGN PATENT DOCUMENTS

| | | | |
|---|---|---|---|
| DE | 102009051795 | B3 | 4/2011 |
| DE | 202015103169 | U1 | 6/2015 |
| EP | 1503896 | A1 | 2/2005 |
| EP | 3106404 | A1 | 12/2016 |
| GB | 2487995 | A | 8/2012 |
| JP | 2009107719 | A | 5/2009 |
| PL | 3106404 | T3 | 10/2018 |
| WO | 9725250 | A1 | 7/1997 |
| WO | 2011054675 | A1 | 5/2011 |
| WO | 2011093699 | A1 | 8/2011 |
| WO | 2012023849 | A1 | 2/2012 |
| WO | 2016040300 | A1 | 3/2016 |

OTHER PUBLICATIONS

Pending PCT Application No. PCT/IB2022?060157 filed Oct. 21, 2022.

* cited by examiner

REMOVABLE CARGO CONTAINER BASE BRACKETS

CROSS-REFERENCE TO RELATED APPLICATIONS

This application is a continuation of U.S. patent application Ser. No. 17/971,075, filed Oct. 21, 2022, which claims priority to, and the benefit of, U.S. Provisional Patent Application Ser. No. 63/270,754, filed Oct. 22, 2021, the entire contents of each of the above applications are hereby incorporated by reference.

BACKGROUND

1. Technical Field

The present disclosure relates to cargo containers and, more specifically, to cargo container bases and removable brackets thereto.

2. Discussion of Related Art

Many air cargo containers utilize a double base construction to allow pickup and moving by forklifts. This type of construction has existed for at least 50 years. A double base construction includes a top plate and a bottom plate that are connected by brackets or other support to handle compressive and shear loading while allowing space for a fork tine from a forklift to enter and pass through the base to lift the base and thus, the container.

During usage, it is very common for the forklift tine to enter a forklift hole in the base at an angle that causes the tine to impact the brackets. Impact from a forklift tine can cause significant damage to brackets which may result in an air cargo container to be unairworthy such that the air cargo container is required to be removed from service and to be repaired.

To replace a damaged bracket for an air cargo container, a repair can require drilling out the rivets holding the bracket to the top plate and rivets holding the bracket to the bottom plate and then removing the damaged bracket through one of the forklift holes. A new bracket can be inserted through one of the forklift holes and then riveted in place allowing the air cargo container to regain its base strength and be returned to service. Drilling out and replacing the rivets on the top plate can require access to the top surface of the top plate to access the rivets.

Typical air cargo containers have bases that allow for access from both the top plate and the bottom plate when empty. However, when a typical air cargo container is loaded, the typical air cargo container must be unloaded to allow access from the top plate. As such, a typical air cargo container must be unloaded to remove a damaged bracket.

In addition, specialty air cargo containers, such as refrigerated containers, the top plate can be covered by insulation, refrigeration ductwork, and/or shelving. As such, repair of specialty air cargo containers may require not only removal of any cargo but also the disassembly of other aspects of specialty air cargo container to allow for access to the top plate to remove a bracket. Although repair of a specialty air cargo container is possible, it is very expensive and time-consuming to remove these added components in order to access the rivets to change the brackets.

Removing the cargo and reloading into another container may require special facilities for customs or for a type of cargo. For example, a chain of custody for cargo may be necessary for customs. In addition, some cargos may be time-sensitive such that removal and reloading may render the cargo to miss a time window for transport. Further, the removal of the cargo can damage or render the cargo unsuitable. For example, refrigerated cargo may experience temperatures outside an acceptable range. Such cargo may be time and/or temperature-sensitive pharmaceuticals.

SUMMARY

This disclosure relates generally to cargo container bases and more specifically, replaceable brackets for cargo container bases. While the replaceable brackets described herein are related to air cargo containers, it is within the scope of this disclosure that the brackets described herein to be used with any container including a double base construction having a top plate and a bottom plate or other similar structure.

The replaceable brackets described herein can be replaced with access through a single plate, e.g., the top plate or the bottom plate. While access is described through the bottom plate, it will be appreciated that the construction can be reversed such that access is through the top plate. Replacement of the brackets through a single plate may allow for repair and/or replacement of damaged brackets without deconstruction of the cargo container, dismantling the cargo container, or removal of cargo from a cargo container.

In an embodiment of the present disclosure, a base for a cargo container including a bottom plate, a top plate, risers, and a bracket. The top plate has a top surface that faces away from the bottom plate. The risers interconnect the top plate and the bottom plate. The bracket extends between the top plate and the bottom plate and is configured to maintain a distance between the top plate and the bottom plate. The bracket is replaceable from the base without access to the top surface of the top plate.

In embodiments, the bracket includes a foot, a head, and a body that interconnects the foot and the head. The foot may be fixed to the bottom plate. The head may be secured to the top plate. The foot may extend perpendicularly from the body and the head may extend perpendicularly from the body. The foot may extend in a first direction from the body and the head may extend from the body in a second direction that is opposite the first direction. The bracket may have a Z-shaped cross-section.

In some embodiments, the foot is fixed to the bottom plate by fasteners that pass through the foot and the bottom plate. The bracket may be replaceable from the base by only removing the fasteners fixing the foot to the bottom plate. The fasteners detailed herein may be blind rivets.

In certain embodiments, the bracket includes a latch that is fixed to the top plate. The latch may secure the head to the top plate. The latch may be fixed to the top plate by fasteners passing through the latch and the top plate. The latch may define a receiver that receives the head of the bracket to secure the head of the bracket to the top plate.

In particular embodiments, the bracket defines a portion of a channel through the base that is configured to receive a tine of a forklift therethrough. The bracket may be orientated to deflect the tine into alignment with the channel when impacted by the tine. The bracket may include a head that is secured to the top plate by a latch. The latch may be configured to secure the head when impacted by the tine.

In another embodiment of the present disclosure, a base for a cargo container includes a bottom plate, a top plate, riser, and a bracket. The risers interconnect the top plate and the bottom plate. The bracket extends between the top plate and the bottom plate and are configured to maintain a distance between the top plate and the bottom plate. The bracket includes a foot, a head, and a body that interconnects the foot and the head. The foot is fixed to the bottom plate and the head is receivably secured to the top plate.

In embodiments, the bracket further comprises a latch that is fixed to the top plate. The latch may define a receiver with the top plate that receives the head to secure the head to the top plate. The latch may include a first layer that is fixed to the top plate and a second layer that extends from the first layer to define the receiver with the top plate. The first layer having a thickness that is substantially equal to a thickness of the head. The head is moveable relative to the top plate when the head is received in the receiver. The bracket may have a Z-shaped cross-section.

In another embodiment of the present disclosure, a base for a cargo container includes a bottom plate, a top plate, risers, and a bracket. The top plate has a top surface that faces away from the bottom plate which is inaccessible. The risers interconnect the top plate and the bottom plate. The bracket extends between the top plate and the bottom plate. The bracket is configured to maintain a distance between the top plate and the bottom plate. The bracket being replaceable.

In embodiments, the bracket includes a foot, a head, and a body that interconnects the foot and the head. The foot is fixed to the bottom plate and the head is secured to the top plate. The foot may be fixed to the bottom plate by fasteners that pass through the foot and the bottom plate.

In some embodiments, the bracket includes a latch that is fixed to the top plate. The latch may secure the head to the top plate. The latch may define a receiver that receives the head of the bracket to secure the head of the bracket to the top plate. The head may be moveable relative to the top plate when the head is received in the receiver and the foot is fixed to the bottom plate.

In embodiments, the bases disclosed herein may include a plurality of other brackets that extend between the top plate and the bottom plate. The plurality of other brackets are configured to maintain a distance between the top plate and the bottom plate. Each other bracket of the plurality of other brackets that are replaceable from the base without access to the top surface of the top plate.

In another embodiment of the present disclosure, a cargo container includes a base as detailed herein, a backwall secured to the base, an opening opposite the backwall, sidewalls secured to the base and opposite one another, and a topwall secured to the backwall and the sidewalls that is opposite the base. The sidewalls may extend from the backwall towards the opening. The cargo container may include a closure that secured to one or both of the sidewalls to seal the opening.

In another embodiment of the present disclosure, a method of repairing a base of a cargo container includes identifying a damaged bracket of the base that extends between the top plate and a bottom plate of the base. The method further includes releasing the damaged bracket form the base without access to the top surface of the top plate of the base. The method further includes securing a new bracket to the base without access to the top surface of the top plate of the base.

In embodiments, releasing the damaged bracket includes removing fasteners fixing a foot of the damaged bracket to the bottom plate of the base. Releasing the damaged bracket may include sliding a head of the damaged bracket out of a latch that secures the head of the damaged bracket to the top plate of the base. Removing the fasteners fixing the foot of the damaged bracket to the base may include accessing a bottom surface of the bottom plate to remove the fasteners.

In some embodiments, securing the new bracket to the base includes sliding a head of the new bracket into a latch that secures the head of the new bracket to the top plate of the base. Securing the new bracket to the base includes fixing a foot of the new bracket to the bottom plate to the base with fasteners that extend through the bottom plate and the foot.

In another embodiment of the present disclosure, a method of repairing a base of a cargo container includes identifying a damaged bracket of the base that extends between a top plate and a bottom plate of the base. The method further includes releasing the damaged bracket from the base without accessing an interior of the cargo container. The method also includes securing a new bracket to the base without accessing the interior of the cargo container.

In embodiments, releasing the damaged bracket includes removing fasteners fixing a foot of the damaged bracket to the bottom plate of the base. Releasing the damaged bracket may include sliding a head of the damaged bracket out of a latch that secures the head of the damaged bracket to the top plate of the base. Removing the fasteners fixing the foot of the damaged bracket to the base may include accessing a bottom surface of the bottom plate to remove the fasteners.

In some embodiments, securing the new bracket to the base includes sliding a head of the new bracket into a latch that secures the head of the new bracket to the top plate of the base. Securing the new bracket to the base includes fixing a foot of the new bracket to the bottom plate to the base with fasteners that extend through the bottom plate and the foot.

Further, to the extent consistent, any of the embodiments or aspects described herein may be used in conjunction with any or all of the other embodiments or aspects described herein.

BRIEF DESCRIPTION OF THE DRAWINGS

Various aspects of the present disclosure are described hereinbelow with reference to the drawings, which are not necessarily drawn to scale, which are incorporated in and constitute a part of this specification, wherein.

DETAILED DESCRIPTION

Figure 1:
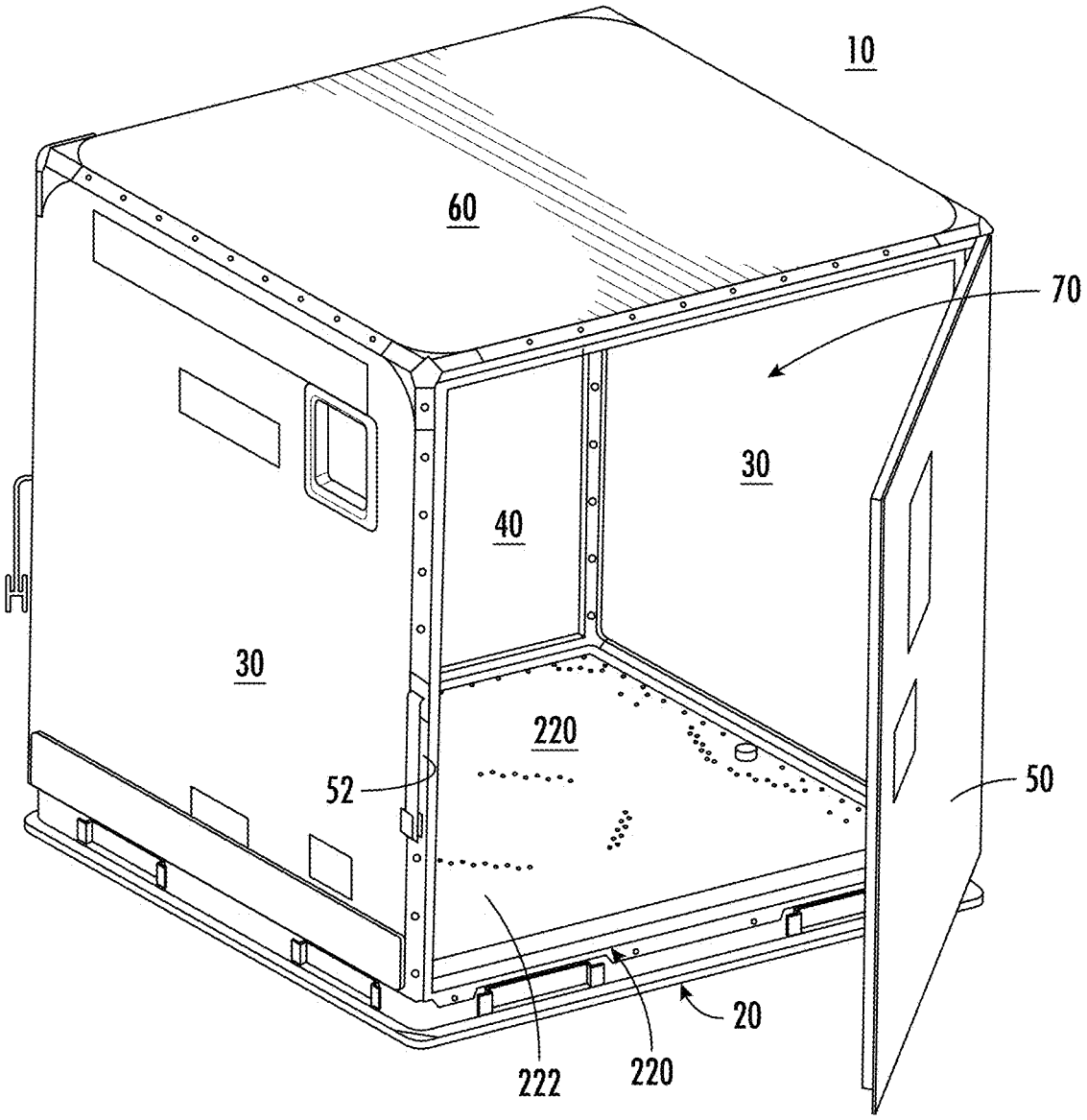
FIG. 1 is a perspective view of a cargo container provided in accordance with an embodiment of the present disclosure.

The present disclosure will now be described more fully hereinafter with reference to example embodiments thereof with reference to the drawings in which like reference numerals designate identical or corresponding elements in each of the several views. These example embodiments are described so that this disclosure will be thorough and complete, and will fully convey the scope of the disclosure to those skilled in the art. Features from one embodiment or aspect can be combined with features from any other embodiment or aspect in any appropriate combination. For example, any individual or collective features of method aspects or embodiments can be applied to apparatus, product, or component aspects or embodiments and vice versa. The disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the," and the like include plural referents unless the context clearly dictates otherwise. In addition, while reference may be made herein to quantitative measures, values, geometric relationships or the like, unless otherwise stated, any one or more if not all of these may be absolute or approximate to account for acceptable variations that may occur, such as those due to manufacturing or engineering tolerances or the like.

As used in the description and the appended claims, the phrases "unit load device" (ULD) or "air cargo container," is defined as containers used to load luggage, freight, mail, and the like on aircraft including wide-body aircraft and narrow-body aircraft. While the containers described herein are directed to ULDs for use with aircraft, it is contemplated that cargo containers including the removable brackets may be used in other transportation vehicles such as trucks, trailers, ships, or trains such that the described use with aircraft should not be seen as limiting.

Referring now to FIG. 1, an air cargo container is provided in accordance with embodiments of the present disclosure and is referred to generally as cargo container 10. The cargo container 10 includes a base 20, sidewalls 30, a backwall 40, a door 50, and a topwall 60 that are secured to one another and cooperate to define an interior 70 of the cargo container 10. As shown, a top surface 222 of a top plate 220 of the base 20 is accessible from the interior 70 of the cargo container 10. The cargo container 10 may include additional structures and/or insulation that prevent access to the top surface 222 of the top plate 220. For example, a cargo container 10 may include active cooling/heating equipment, insulation, shelving, or other structures that prevent access to the top surface 222. In addition, when the cargo container 10 is loaded, the top surface 222 of the top plate 220 may be in accessible due to cargo obscuring portions of the top surface 222.

The container 10 may be designed to hold 3500 pounds with a vertical safety factor of 5 such that the base 20 may be designed to safely hold 17,500 pounds. There are other forces that may require the base 20 to sustain 9,800 pounds in one or more other directions. The high load specification and design strength of the base 20 may be critical for the container 10. In addition, air cargo containers are transported on and off airport by forklifts, e.g., standard forklifts, that engage and lift the base 20 of the container 10 to lift and move the container 10. It is common for the base 20 and other parts of an air cargo container 10 to be damaged from erratic driving practices including, but not limited to, being dropped, colliding with other air cargo containers, pierced by forklift tines, rolled or tipped over, colliding with other parts of a forklift or other vehicles. When an air cargo container is damaged, it may become unairworthy and require repair to return it to airworthiness.

The sidewalls 30, backwall 40, door 50, and the topwall 60 may have a variety of constructions. While the sidewalls 30, backwall 40, door 50, and the topwall 60 are shown as rigid structures, one or more of the sidewalls 30, backwall 40, door 50, and the topwall 60 may be flexible. For example, the door 50 may be a fabric door that selectively closes or seals an opening 52 of the cargo container 10.

Figure 2:
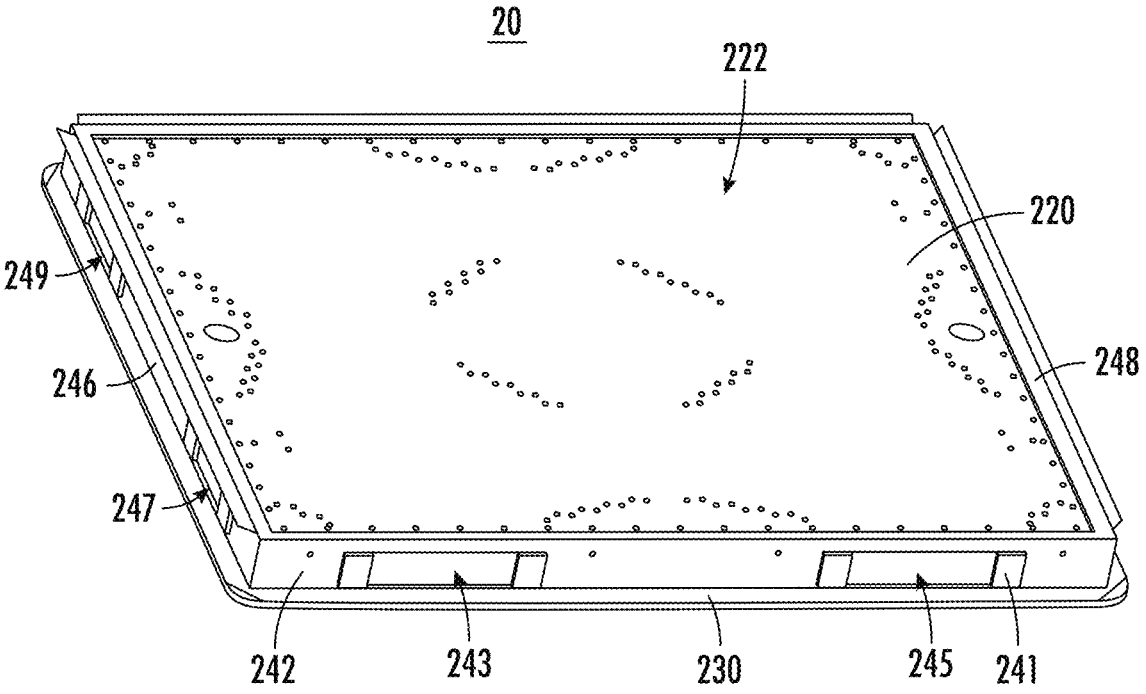
FIG. 2 is perspective view of a base of the cargo container of FIG. 1.
Figure 3:
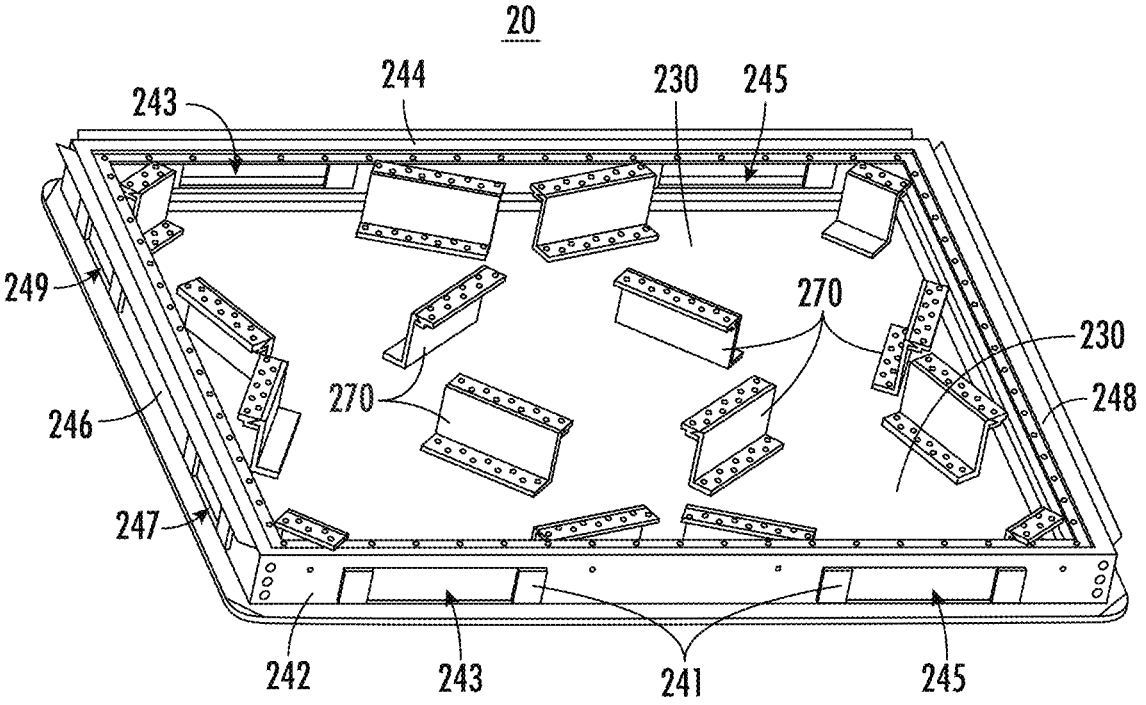
FIG. 3 is a perspective view of the base of FIG. 2 with the top plate removed.

With additional reference to FIGS. 2 and 3, the base 20 is detailed in accordance with embodiments of the present disclosure. The base 20 includes the top plate 220, a bottom plate 230, and risers 242, 244, 246, 248 extending between the top plate 220 and the bottom plate 230. The risers include a front riser 242, a back riser 244, and side risers 246, 248. At least the front riser 242 and the back riser 244 define holes 243, 245 that provide access for forklift tines to pass through the base 20 and allow the base 20, and the cargo container 10 to be lifted by a forklift or other lifting apparatus. In some embodiments, the side risers 246, 248 also include holes 247, 249 that provide access for forklift tines to pass through the base 20 and allow the base 20, and the cargo container 10 to be lifted by a forklift or other lifting apparatus. The holes 243, 245, 247, 249 may include impact plates 241 on the sides of the holes 243, 245, 247, 249 to protect the sides of the holes 243, 245, 247, 249. The impact plates 241 may wrap around the sides of the respective riser 242, 244, 246, 248 and be positioned on an outside surface and an inside surface of the respective riser 242, 244, 246, 248. The risers 242, 244, 246, 248 may include a top flange 252 and/or a bottom flange 254 to join with the top plate 220 or the bottom plate 230 respectively. The risers 242, 244, 246, 248 maybe welded, riveted, and/or joined with fasteners to the top plate 220 and/or the bottom plate 230 respectively.

The base 20 includes a plurality of brackets 270 disposed between the top plate 220 and the bottom plate 230. The brackets 270 are secured to the top plate 220 and the bottom plate 230 to provide compressive strength to the base 20, e.g., to resist a downward force from the top plate 220 towards the bottom plate 230. The brackets 270 also provide shear strength to the base 20 such that the brackets 270 prevent sliding of the top plate 220 relative to the bottom plate 230 in directions parallel to planes of the top plate 220 and the bottom plate 230.

Figure 4:
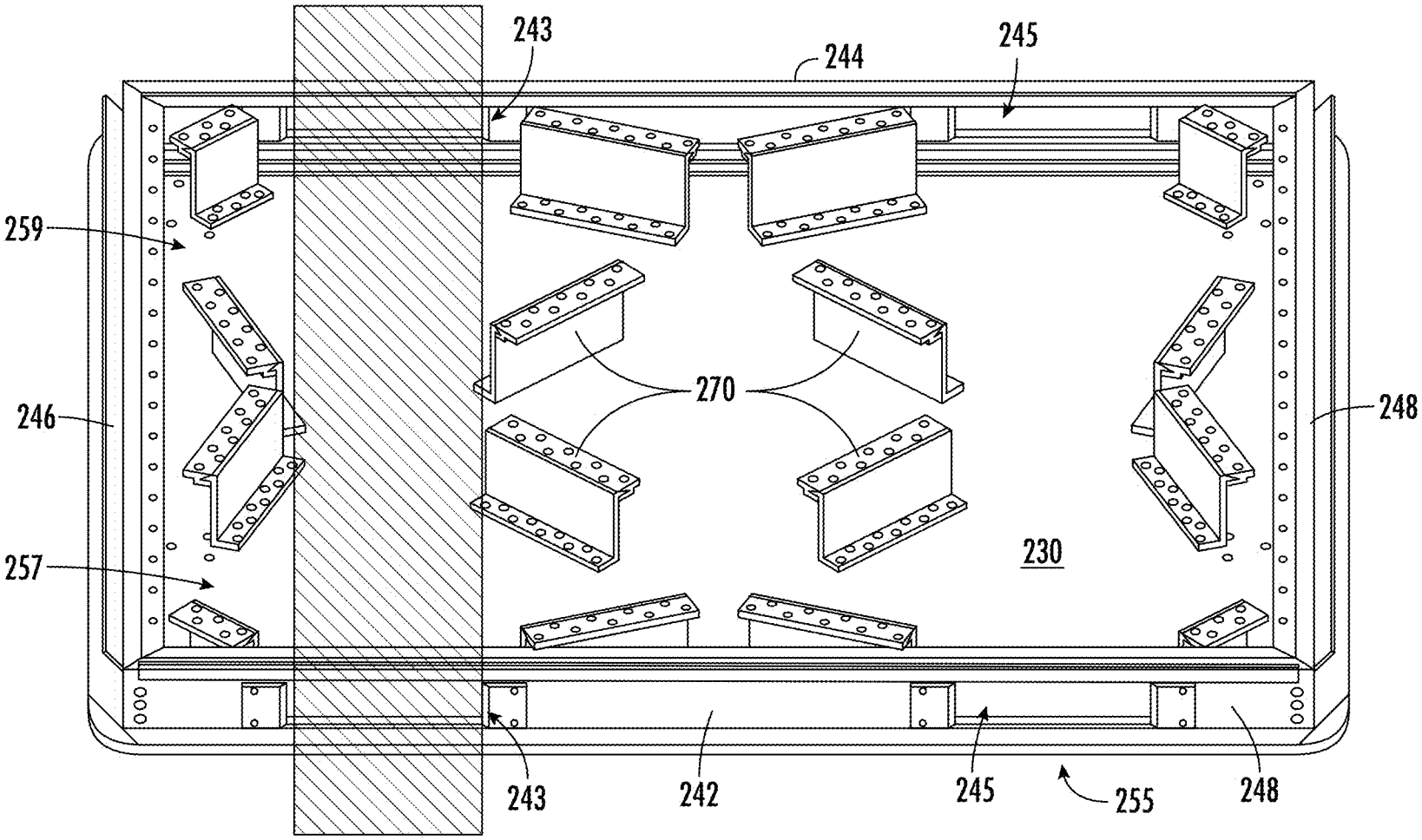
FIG. 4 is a front perspective view of the base of FIG. 3 illustrating a channel for a forklift tine therethrough.
Figure 5:
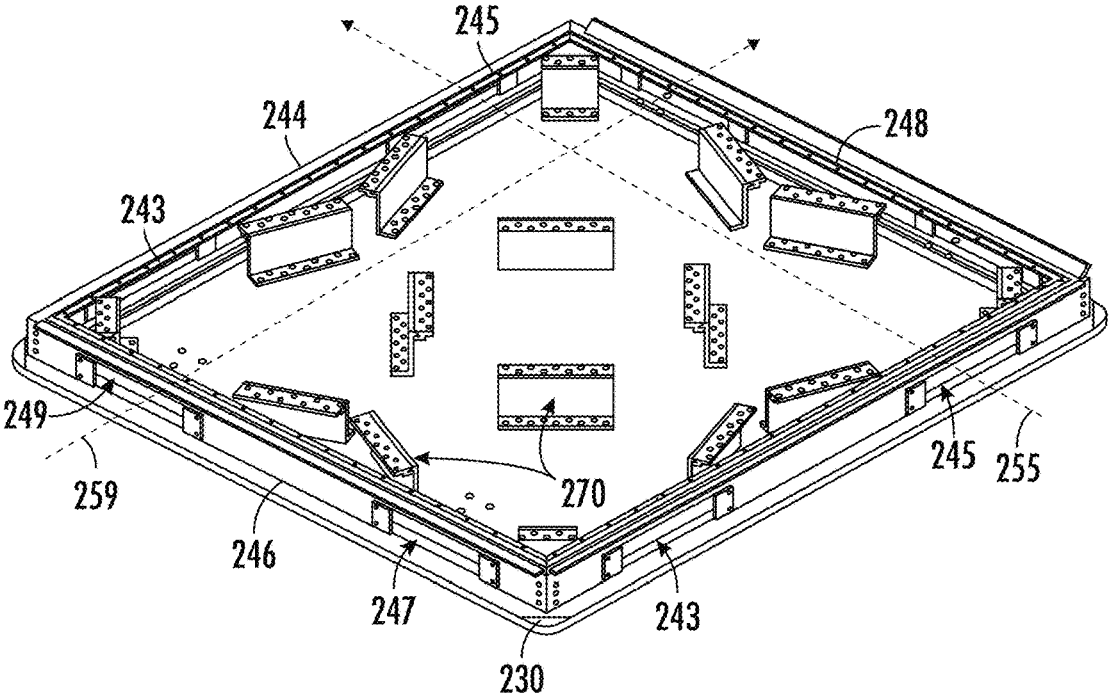
FIG. 5 is a perspective view of the base of FIG. 3 illustrating the contact path of a forklift tine with support brackets.
Figure 6:
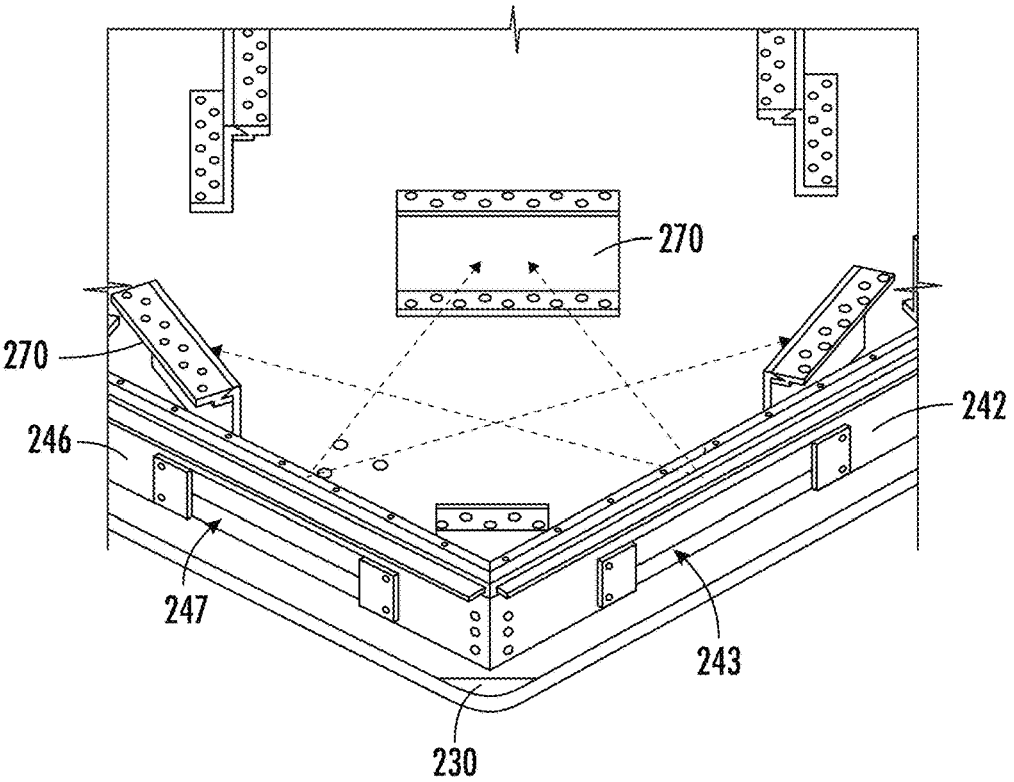
FIG. 6 is an enlarged view of base of FIG. 5.

Referring now to FIGS. 4 and 5, the brackets 270 are arranged and oriented between the top plate 220 and the bottom plate 230 to allow for the passage of tines of a forklift through the base 20. For example, the holes 243 and 245 and the brackets 270 define a first channel 253 and a second channel 255 that extend through the base 20 perpendicular to the risers 242 and 244. The holes 247 and 249 and the brackets 270 define a third channel 257 and a fourth channel 259 through the base 20 perpendicular to the risers 246 and 248.

The brackets 270 are oriented to deflect impacts from forklift tines such that the forklift tines are directed into the respective channel 253, 255, 257, 259. It will be appreciated that when a forklift engages a base 20, it is rare for the forklift to be aligned with the base 20 such that the tines of the forklift will pass through a channel of the base without contacting one of the brackets 270. As such, the brackets 270 are oriented such that when a tine of the forklift enters a respective hole of the base, the tine will impact one or more of the brackets 270. As the tine impacts the brackets 270, the brackets deflect the tine such that the tine is directed towards the channel or the base 20 is rotated such that the tine is directed into the respective channel. The orientation of the brackets 270 may deflect a substantial amount of force from the tines such that the brackets 270 are capable of withstanding multiple impacts from tines. However, at times, the force of the tine impacting the bracket 270 may break or damage a bracket 270.

Figure 7:
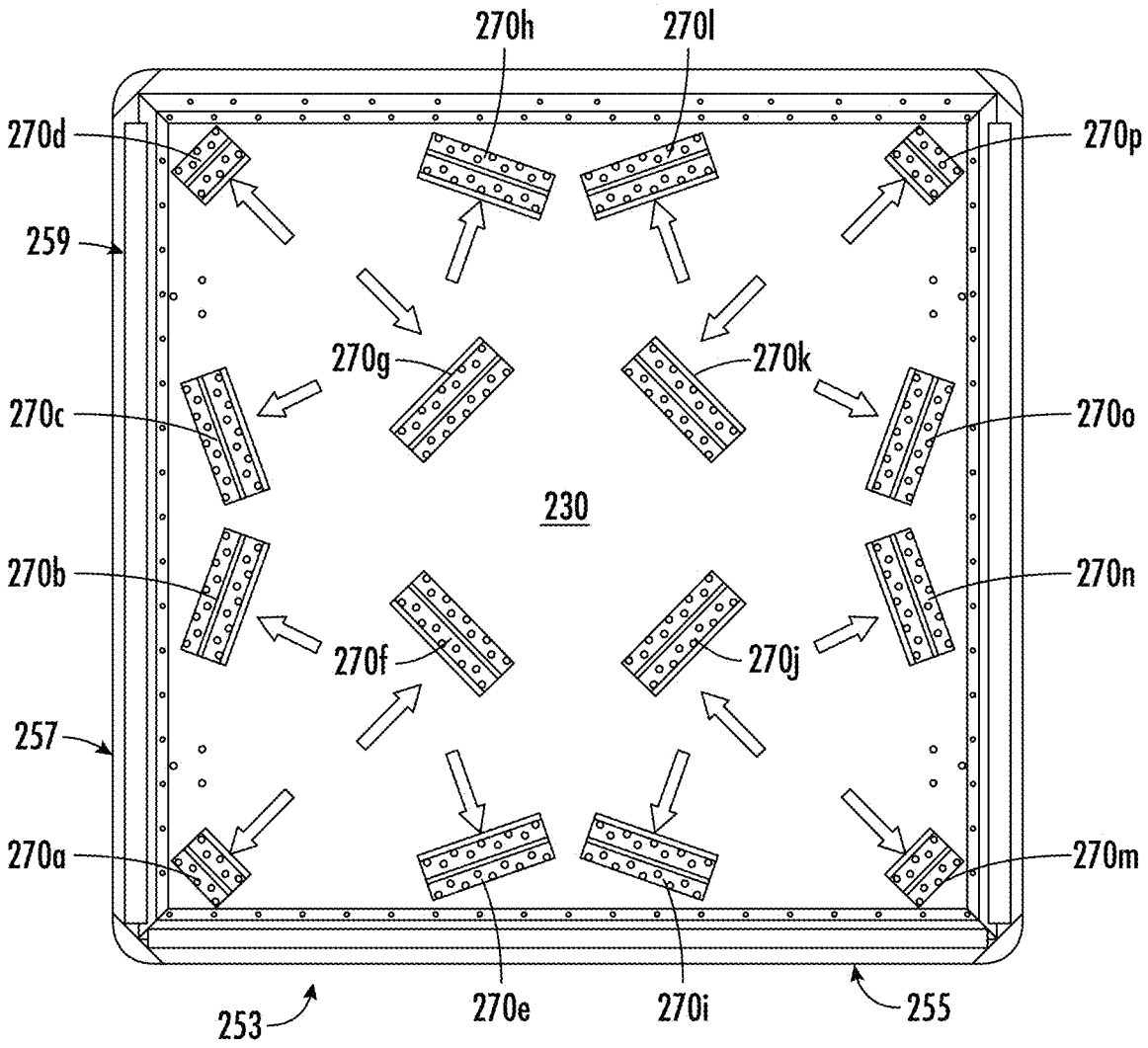
FIG. 7 is a top view of the base of FIG. 3 illustrating impact directions of the support brackets.

With reference to FIG. 7, the brackets 270 are orientated such that the brackets 270 that may be impacted on a face by a tine of a forklift such that the face directs the tine towards a respective channel with the tines passing subsequent brackets 270 that may direct a tine coming in from the opposite hole into the respective channel. The orientation of the brackets 270 may reduce potential damage to the bracket when impacted by the tine and/or prevent the tine from impacting another one of the brackets 270.

For example, when a tine enters channel 253 through the opening 243, the tine will pass brackets 270*a* and 270*e*. If the tine is out of alignment with the channel 253, the tine may impact a face of bracket 270*b* or 270*f*. Upon impact with the face of the respective bracket 270*b*, 270*f*, the orientation of the bracket 270*b*, 270*f* directs the tine into alignment with the channel 253 and towards the opening 243 in the opposite riser. In addition, the brackets 270*b*, 270*f* may be orientated to minimize the impact force that is absorbed by the bracket 270*b*, 270*f*. When the tine passes brackets 270*b*, 270*f*, the tine will also clear brackets 270*c*, 270*g*. The tine may contact bracket 270*d*, 270*h* before exiting through the opening 243 which direct the tine towards the other opening 243.

Figure 8:
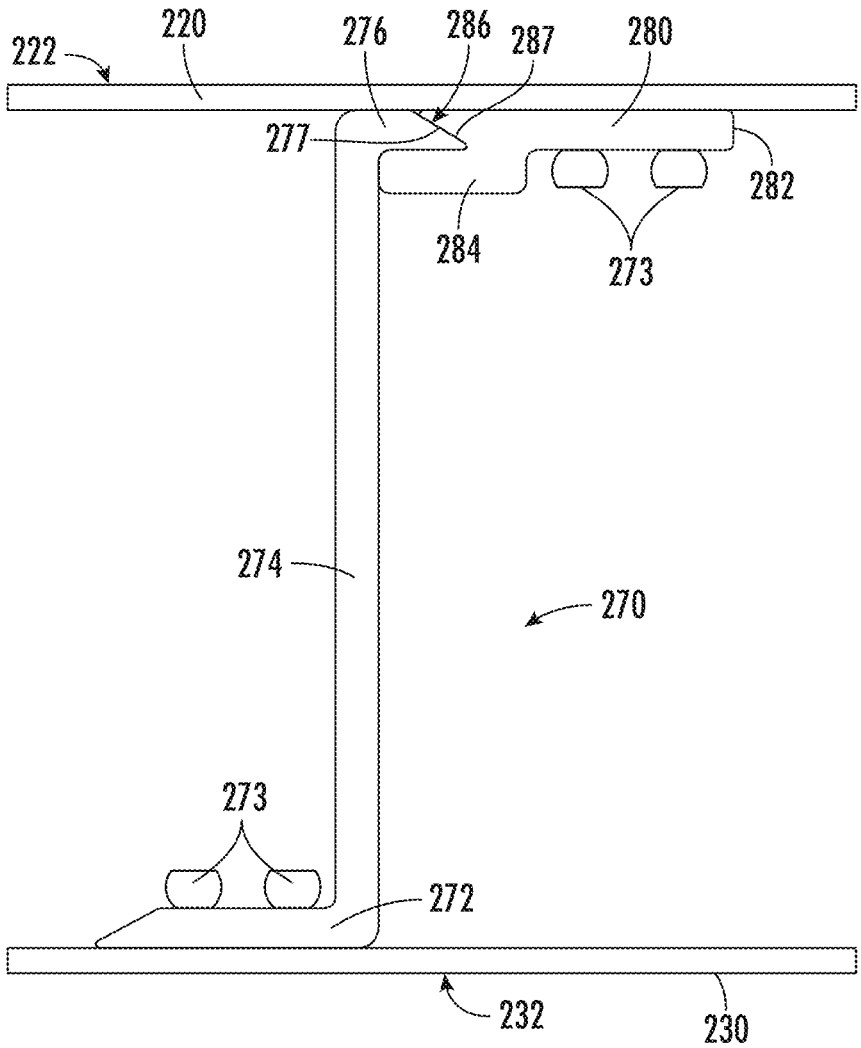
FIG. 8 is a side view of a support bracket provided in accordance with the present disclosure.
Figure 9:
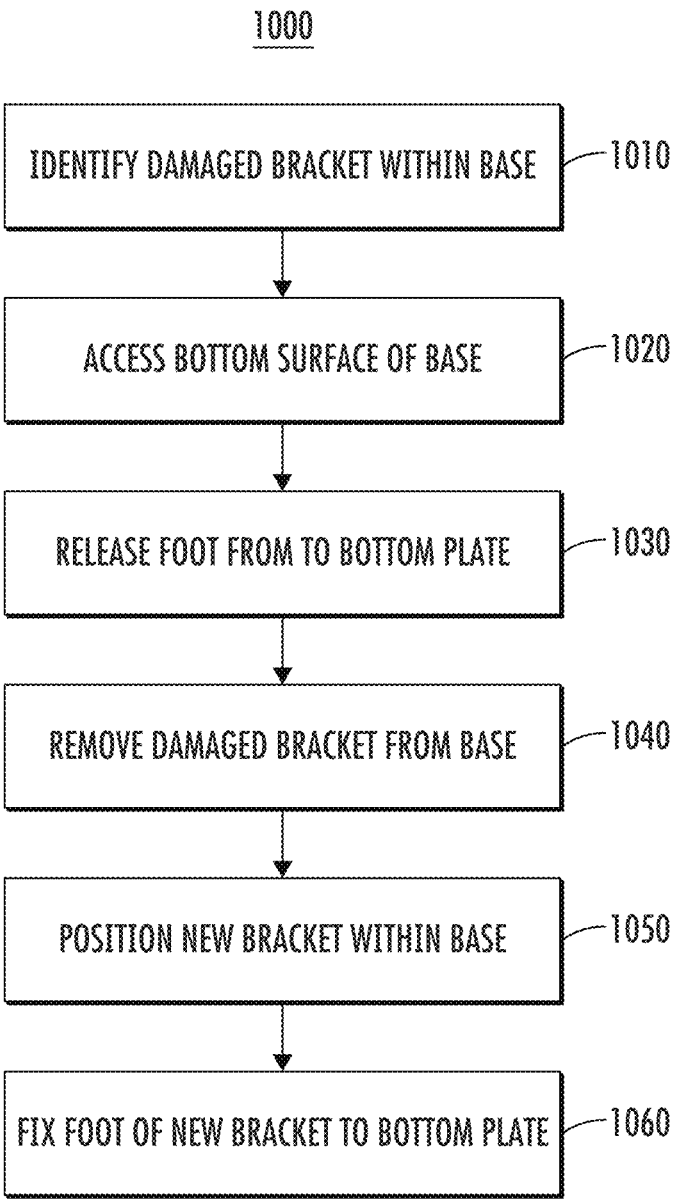
FIG. 9 is a flowchart illustrating a method of replacing a support bracket provided in accordance with the present disclosure.
Figure 10:
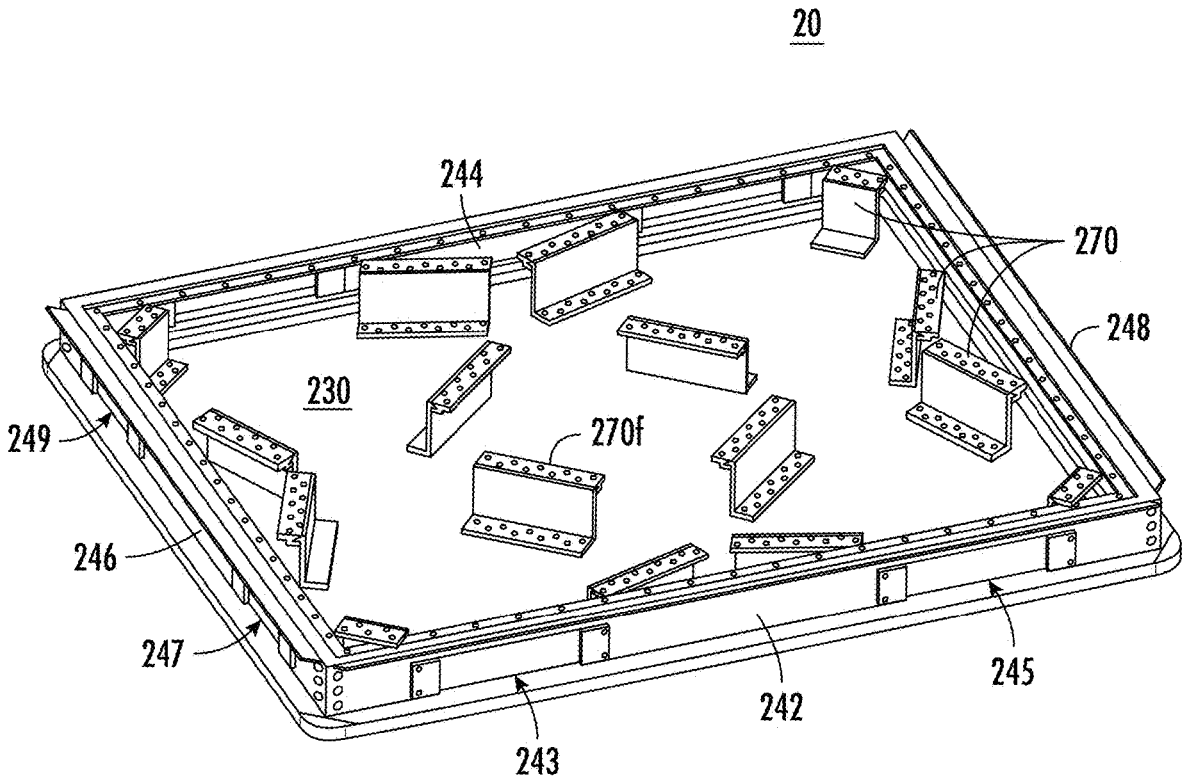
FIG. 10 is a perspective view of the base of FIG. 3 identifying a damaged bracket to be removed.

Referring now to FIG. 8, the construction of a bracket 270 is described in accordance with embodiments of the present disclosure. The bracket 270 includes a foot 272, a vertical body 274, and a head 276. The foot 272 is substantially perpendicular to the body 274 and extends in a first direction away from the body 274. The head 276 is substantially perpendicular to the body 274 and extends in a second direction away from the body 274 that is opposite the first direction such that the bracket 270 has a Z-shaped profile. In embodiments, the first and second direction may be the same direction such that the bracket 270 has a C-shaped profile. The bracket 270 may be formed from a single sheet of material that is folded or bent to the Z-shaped profile or other profile. In embodiments, the foot 272 and/or the head 276 may extend from the body 274 at an angle other than perpendicular. For example, the foot 272 and/or the head 276 may extend from the body 274 at an angle in a range of 30 degrees to 90 degrees, e.g., 30, 35, 40, 45, 50, 55, 60, 65, 70, 75, 80, 85, or 90 degrees. A foot 272 and/or head 276 that extends at angles other perpendicular may allow the brackets 270 to withstand additional shear forces compared to a perpendicular angle.

The foot 272 of the bracket 270 is fixed to the bottom plate 230 by one or more rivets 273. In some embodiments, the foot 272 is fixed to the bottom plate 230 by one or more fasteners 273, e.g., rivets, screws, bolts, etc. As detailed below, the fasteners 273 may be rivets 273 that may fix the foot 272 to the bottom plate 230 such that the foot 272 can be removed by drilling out the rivets 273. The rivets 273 may be blind rivets such that the rivets 273 do not extend above a top surface 222 of the top plate 220 and/or the bottom surface 232 of the bottom plate 230.

The head 276 is moveably secured or retained to the top plate 220 by a latch 280. The latch 280 has a first layer 282 and a retainer 284. The first layer 282 is fixed to the top plate 220 by one or more rivets 273. The rivets 273 may fix the latch 280 to the top plate 220. In embodiments, the latch 280 is fixed to the top plate 220 by one or more fasteners. The latch 280 is positioned such that the retainer 284 defines a receiver 286 with the top plate 220. The first layer 282 and the receiver 286 may be shaped such that the receiver 286 complements the shape of the head 276. For example, the head 276 may include a slanted surface 277 that mates with a slanted surface 287 of the receiver 286. The cooperation of the slanted surfaces 277, 287 may improve securement of the head 276 in the receiver 286. The low profile of the latch 280 may prevent damage to the latch 280 when the body 274 of the bracket 270 is impacted. In embodiments, the first layer 282 of the latch 280 has a thickness that is substantially equal to the thickness of the head 276 of the bracket 270 such that the receiver 286 can receive and release the head 276 of the bracket. The bracket 270 may be oriented within the base 20 such when the body 274 is contacted or impacted from a predicted direction, as detailed above with respect to FIG. 7, the head 276 is directed into the latch 280 such that the latch 280 retains the head 276 and resists a force of the impact for the top of the bracket 270.

The construction of the bracket 270 allows for the bracket 270 to be replaced without access to the top surface 222 of the top plate 220 of the base 20. As such, the bracket 270 is replaceable without disassembly or removal of insulation or other structures from the cargo container 10. In some embodiments, the bracket 270 can be replaced without unloading or opening of the cargo container 10 such that the integrity and/or a temperature within the cargo container 10 can be maintained during the replacement of the bracket 270.

It will be appreciated that in it may be possible to construct the brackets 270 such that the brackets 270 will not be damaged when impacted by a tine. However, as weight is of importance with respect to cargo containers and especially air cargo containers, that providing a bracket that is strong for normal use and allows for replacement when damaged is preferred to a heavy bracket that may survive more significant impacts. The brackets 270 are designed such that the body 274 is designed as the failure point of the bracket 270 such that when a bracket 270 is damaged, the latch 280 is undamaged. The low profile of the latch 280 may reduce a possibility of damage to the latch 280 when the body 274 is damaged.

Referring now to FIGS. 9-15, a method 1000 of replacing a damaged bracket 270 of a cargo container 10 in accordance with the present disclosure. With initial reference to FIG. 10, a damaged bracket 270 is identified within the base 20 (Step 1010). For example, the bracket 270*f* may be damaged from a forklift tine that entered the opening 243 or the opening 247 and impacted the bracket 270*f*. It should be appreciated that the method 1000 may be used to replace any of the brackets 270 of the base 20.

Figure 11:
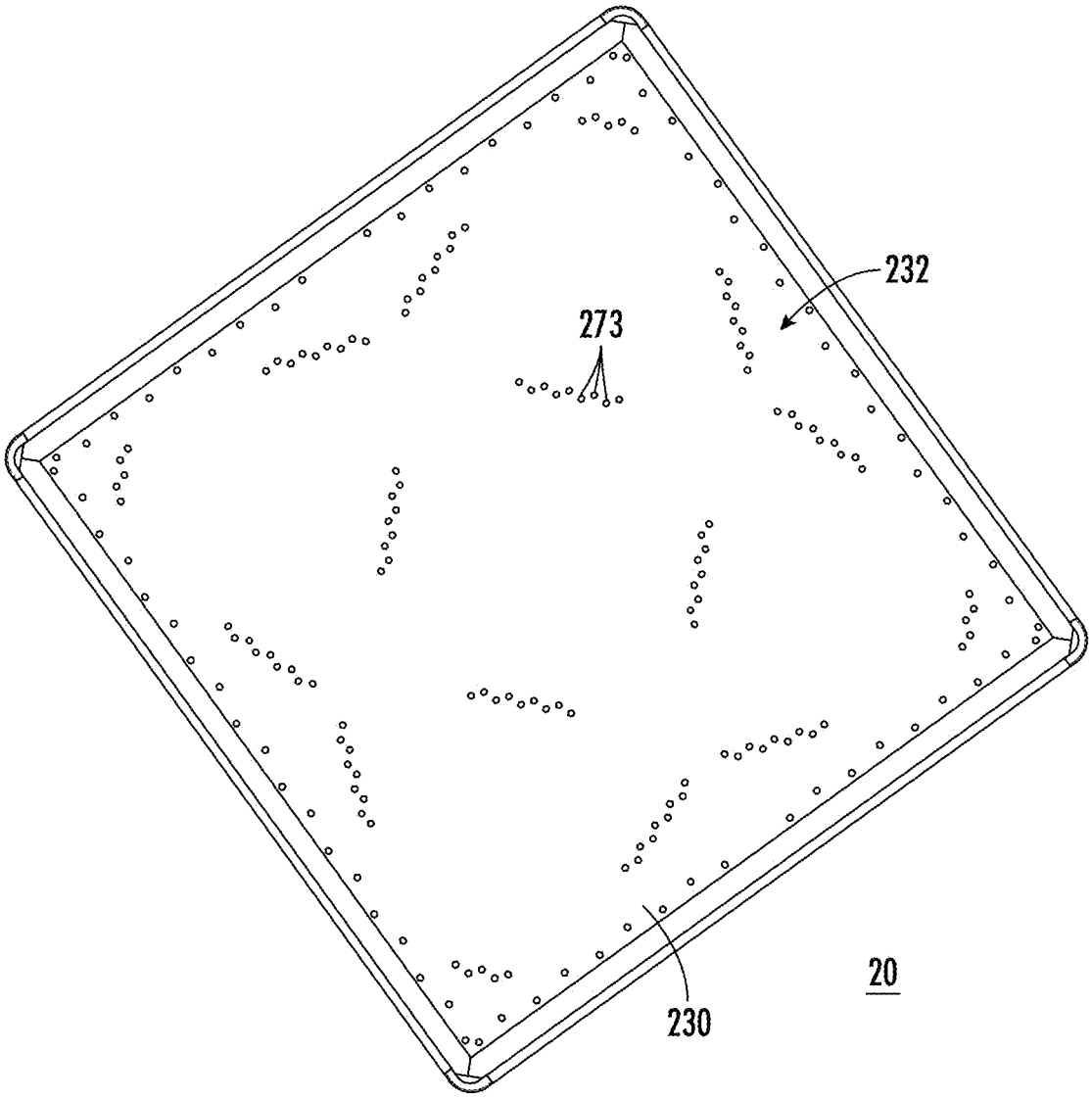
FIG. 11 is a bottom view of the base of FIG. 10.

With particular reference to FIG. 11, with the damaged bracket 270 identified, the base 20 is positioned in a manner to allow access to a bottom surface 232 of the bottom plate 230 (Step 1020). To allow access to the bottom surface 232, the base 20 may be lifted, e.g., by a forklift or other lifting means, such that a technician can access the rivets 273 of the damaged bracket 270 through the bottom surface 232 of the bottom plate 230. In some embodiments, the base 20 may be positioned over a tunnel or pit that allows for access to the bottom surface 232 by a technician standing underneath the base 20 with the base fully supported. With access to the bottom surface 232 of the bottom plate 230, a technician drills out the rivets 273 or otherwise removes the rivets 273 or other fasteners fixing the foot 272 of the bracket 270 to the bottom plate 230 (Step 1030). With the rivets 273 removed from the foot 272, the foot 272 of the bracket 270 is unsecured or released from the bottom plate 230.

Figure 12:
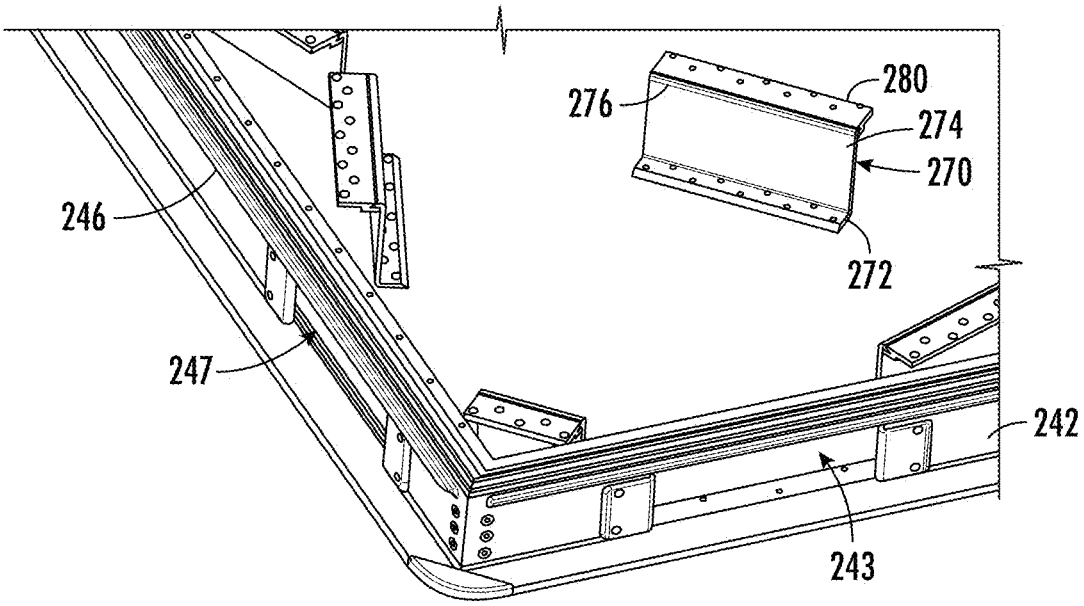
FIG. 12 is a perspective view of the base of FIG. 10 with the damaged bracket ready to be removed.

With the foot 272 unsecured from bottom plate 230, the bracket 270 is removed from the base 20 through the opening 243 or the opening 247 as shown in FIG. 12 (Step 1040). The bracket 270 may be removed by reaching through the opening 243 or opening 247 and grasping the body 274 of the bracket 270. As the only rivets 273 or fasteners fixing the bracket 270 in the base 20 were the rivets 273 in the bottom plate 230 and the foot 272, the bracket 270 is free once the rivets 273 in the bottom plate 230 and the foot 272 are removed. The head 276 may need to be persuaded to remove the head 276 from the receiver 286 (FIG. 8). For example, the head 276 may become wedged or jammed into the latch 280 due to impacts to the body 274 of the bracket 270. When the bracket 270 is free from the latch 280, the bracket 270 can be withdrawn or removed from the base 20 through the closest opening, e.g., opening 243, 247. The bracket 270 may be rotated to withdraw the bracket 270 through the opening.

Figure 13:
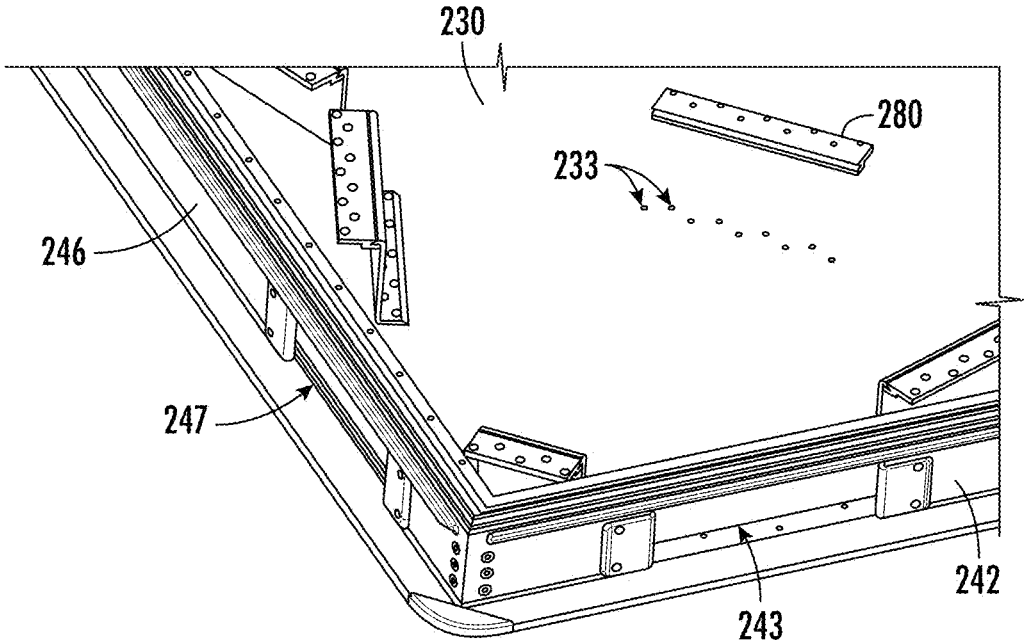
FIG. 13 is a perspective view of the base of FIG. 10 with the damaged bracket removed.
Figure 14:
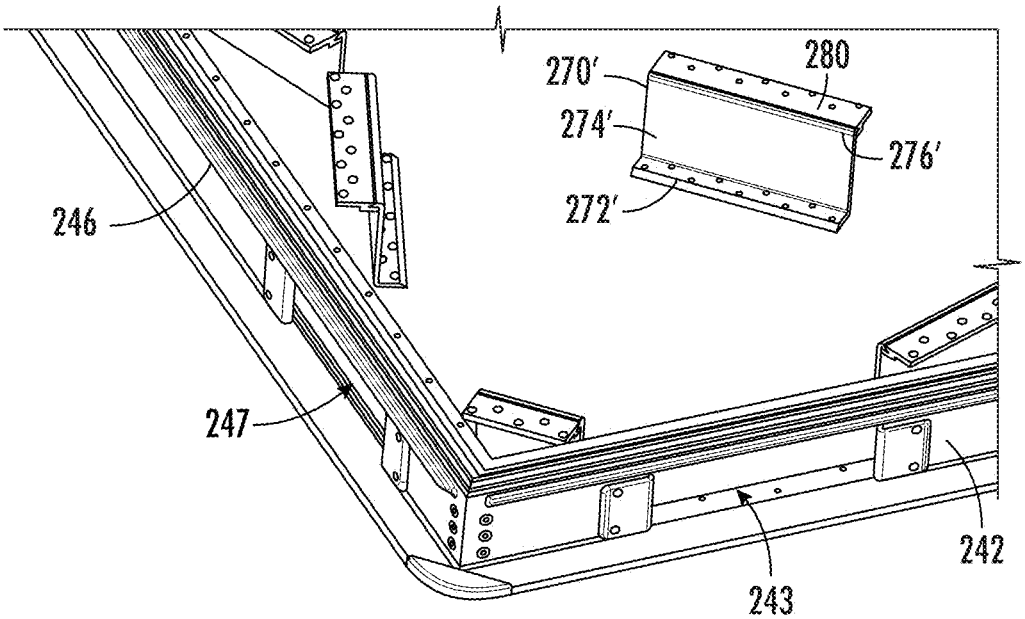
FIG. 14 is a perspective view of the base of FIG. 13 with a replacement bracket positioned in the base.
Figure 15:
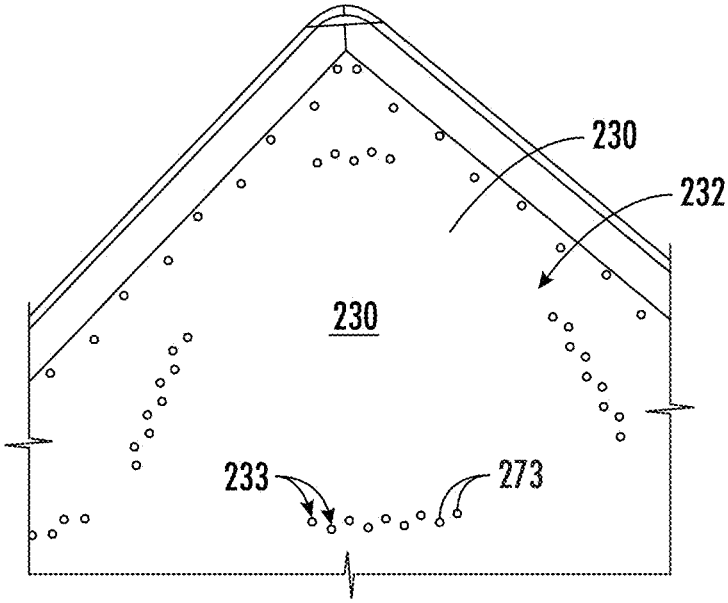
FIG. 15 is a bottom view of the base of FIG. 14.

When the old, damaged bracket 270 is removed through the opening, the latch 280 remains fixed to the top plate 220 of the base 200 as shown in FIG. 13. With the damaged bracket 270 removed, a new bracket 270' is passed through the opening and positioned within the base 200 as shown in FIG. 14 (Step 1050). To position the new bracket 270' in the base 200, a head 276' of the new bracket 270' is positioned within the receiver 286 of the latch 280 and a foot 272' of the new bracket 270' is positioned such that holes in the foot 272' are aligned with holes in the bottom plate 230 of the base 200 such that the foot 272' can be fixed to the bottom plate 230. With the new bracket 270' positioned in the base 200, the foot 272' of the new bracket 270' is fixed to the bottom plate 230 as shown in FIG. 15 (Step 1060). For example, the foot 272' may be fixed by using blind rivets passed through the holes in bottom plate 230 and the holes in the foot 272' to secure the foot 272' to the bottom plate 230. The use of blind rivets may allow for the securement of the foot 272' without any portion of the rivets extending below a bottom surface 232 of the bottom plate 230. In some embodiments, other types of fasteners may be used to fix the foot 272' to the bottom plate 230.

The method 1000 detailed above may be performed by only accessing the bottom plate 230 of the base 200. More specifically, the method 1000 may be performed without access to the top surface 222 of the top plate 220. By allowing replacement of a bracket 270 from only the bottom plate 230, the bracket 270 may be replaced without disassembly of a cargo container or without opening a cargo container such that cargo can remain in the cargo container during replacement. In some embodiments, a support may be replaced without breaking a seal of the cargo container to maintain an integrity of the interior of the cargo container.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A base for a cargo container, the base comprising:
a bottom plate;
a top plate;
a latch fixed to the top plate, the latch defining a receiver with the top plate; and
a bracket having a foot, a head, and a body interconnecting the foot and the head, the bracket extending between the bottom plate and the top plate, the foot removably fixed to the bottom plate, the head received within the receiver to secure the head to the top plate, the head moveable with respect to the latch and the top plate when the head is received in the receiver.

2. The base according to claim 1, wherein the latch includes a first layer that is fixed to the top plate and a second layer that extends from the first layer, the latch defining the receiver between the second layer and the top plate.

3. The base according to claim 2, wherein the first layer has a thickness substantially equal to a thickness of the head.

4. The base according to claim 1, wherein the bracket is configured to maintain a distance between the top plate and the bottom plate.

5. The base according to claim 1, wherein the body is configured to fail before the latch.

6. The base according to claim 1, wherein the top plate has a top surface facing away from the bottom plate, the bracket configured to be replaced without access to the top surface of the top plate.

7. The base according to claim 1, further comprising risers interconnecting the top plate and the bottom plate, each riser defining an opening, the bracket configured to be replaced entirely through the openings between the top plate and the bottom plate.

8. The base according to claim 7, wherein the top plate and the bottom plate are solid.

9. The base according to claim 1, wherein the latch is fixed to the top plate by fasteners passing through the latch and the top plate.

10. A cargo container comprising:
a base according to claim 1;
backwall secured to the base;
an opening opposite the backwall;
sidewalls secured to the base and opposite one another, the sidewalls extending from the backwall towards the opening; and
a topwall secured to the backwall and the sidewalls opposite the base.

11. A base for a cargo container, the base comprising:
a bottom plate;
a top plate;
a latch fixed to the top plate, the latch defining a receiver with the top plate; and
a bracket configured to be replaceable separate from the bottom plate and the top plate, having a foot, a head, and a body interconnecting the foot and the head, the bracket extending between the bottom plate and the top plate, the foot fixed to the bottom plate, the head received within the receiver to secure the head to the top plate, the head configured to move within the receiver to prevent damage to the latch when the head is secured to the top plate.

12. The base according to claim 11, comprising a plurality of risers interconnecting the top plate and the bottom plate, each riser defining an opening, the bracket configured to be replaced entirely through the openings between the top plate and the bottom plate.

13. The base according to claim 11, wherein the body is configured to fail before the latch.

14. The base according to claim 11, wherein the top plate has a top surface facing away from the bottom plate, the bracket configured to be replaced without access to the top surface of the top plate.

15. The base according to claim 14, wherein the top plate has a bottom surface opposite the top surface facing the bottom plate, the latch fixed to the bottom surface of the top plate by fasteners passing through the latch and the top plate.

16. A cargo container comprising:

a base according to claim 11;

backwall secured to the base;

an opening opposite the backwall;

sidewalls secured to the base and opposite one another, the sidewalls extending from the backwall towards the opening; and a topwall secured to the backwall and the sidewalls opposite the base.

17. A method of repairing a base of a cargo container, the method comprising:

identifying a damaged bracket of the base that extends between a top plate and a bottom plate of the base, a latch fixed to the top plate and defining a receiver therewith, the damaged bracket having a foot removably fixed to the bottom plate and a head received within the receiver;

releasing the damaged bracket from the base without access to a top surface of the top plate of the base, including unfixing the foot of the damaged bracket from the bottom plate and withdrawing the head from the receiver; and securing a new bracket to the base without access to the top surface of the top plate of the base, including inserting a head of the new bracket into the receiver and removably fixing a foot of the new bracket to the bottom plate.

18. The method according to claim 17, wherein releasing the damaged bracket comprises:

removing fasteners fixing the foot of the damaged bracket to the bottom plate of the base; and sliding the head of the damaged bracket out of the receiver of the latch that secures the head of the damaged bracket to the top plate of the base.

19. The method according to claim 18, wherein removing the fasteners fixing the foot of the damaged bracket to the base includes accessing a bottom surface of the bottom plate to remove the fasteners.

20. The method according to claim 17, wherein securing the new bracket to the base comprises:

sliding the head of the new bracket into the receiver of the latch that secures the head of the new bracket to the top plate of the base; and fixing the foot of the new bracket to the bottom plate to the base with fasteners that extend through the bottom plate and the foot.

* * * * *